United States Patent [19]

Specht

[11] 4,273,630

[45] Jun. 16, 1981

[54] PROCESS FOR THE START-UP OF MEMBRANE CELLS FOR THE ELECTROLYSIS OF AQUEOUS SALT SOLUTIONS

[75] Inventor: Steven J. Specht, Mentor, Ohio

[73] Assignee: Olin Corporation, New Haven, Conn.

[21] Appl. No.: 114,481

[22] Filed: Jan. 23, 1980

[51] Int. Cl.[3] ..... C25B 15/00; C25B 15/02; C25B 15/08; C25B 1/34

[52] U.S. Cl. ..... 204/98; 204/128

[58] Field of Search ..... 204/98, 128, 257, 258

[56] References Cited

U.S. PATENT DOCUMENTS

| | | | |
|---|---|---|---|
| 3,985,631 | 10/1976 | Hora et al. | 204/98 |
| 4,013,535 | 3/1977 | White | 204/98 |
| 4,110,191 | 8/1978 | Specht et al. | 204/266 |
| 4,115,237 | 9/1978 | Woodward, Jr. et al. | 204/258 |
| 4,204,920 | 5/1980 | Kurtz et al. | 204/98 |

*Primary Examiner*—R. L. Andrews

*Attorney, Agent, or Firm*—James B. Haglind; Donald F. Clements

[57] ABSTRACT

A process for the start-up of membrane cells for the electrolysis of an aqueous salt solution for cells having an anode compartment containing a plurality of anodes, a cathode compartment containing a plurality of cathodes and an ion exchange membrane separating the anode compartment from the cathode compartment is comprised of the steps of:

(a) feeding simultaneously the aqueous salt solution to the anode compartment and a liquid to the cathode compartment while maintaining substantially equal pressure on the membrane from each of the compartments, (b) increasing the pressure on the membrane from the anode compartment, (c) increasing the pressure on the membrane from the cathode compartment, and (d) cyclically repeating steps (b) and (c) during the start-up period.

The novel process reduces wrinkling and eliminates cracking of the membrane during the start-up period of, for example, a cell for the electrolysis of alkali metal chloride brines for the production of chlorine and alkali metal hydroxides.

11 Claims, No Drawings

PROCESS FOR THE START-UP OF MEMBRANE CELLS FOR THE ELECTROLYSIS OF AQUEOUS SALT SOLUTIONS

This invention relates to the electrolysis of aqueous salt solutions in cells employing an ion exchange membrane. More particularly, the invention relates to the start-up procedures employed with membrane cells.

Ion exchange membranes used to separate the anode compartment from the cathode compartment in membrane electrolytic cells change dimensions in response to electrolyte concentrations and cell operating conditions. If the expansion of the membrane is uncontrolled during the cell start-up period, formation of wrinkles in the membrane surface will result. These wrinkles are known to be the sites for the initiation of cracks in the membrane. Cracks permit leakage of fluids between the compartments which results in contamination of the cell products and reduced cell performance.

It is an object of the present invention to provide a process for the controlled expansion of ion exchange membranes during the cell start-up period.

Another object of the present invention is to provide a process in which wrinkle formation in the membrane surface is minimized.

A further object of the present invention is to provide a process for preventing the formation of cracks in the membrane surface.

These and other objects of the invention are accomplished in a process for the start-up of membrane cells for the electrolysis of an aqueous salt solution, the cells having an anode compartment containing a plurality of anodes, a cathode compartment containing a plurality of cathodes, and an ion exchange membrane separating the anode compartment from the cathode compartment, the process which comprises the steps of:

(a) feeding simultaneously the aqueous salt solution to the anode compartment and a liquid to the cathode compartment while maintaining substantially equal pressure on the membrane from each of the compartments, (b) increasing pressure on the membrane from the anode compartment, (c) increasing pressure on the membrane from the cathode compartment, and (d) cyclically repeating steps b and c during the start-up period.

The novel process of the present invention is employed in electrolytic cells for the electrolysis of aqueous salt solutions, for example, alkali metal chloride brines used in the production of chlorine and alkali metal hydroxides or aqueous basic solutions such as alkali metal hydroxide used in the production of oxygen and hydrogen gases. Electrolytic cells used in these processes include monopolar and bipolar type cells including filter press cells. In these cells, ion exchange membranes separate the anode compartment from the cathode compartment. The manner in which the membranes are placed to separate these electrode compartments is not critical and any suitable arrangement may be used. For example, the membranes may be placed vertically or horizontally and may be spaced apart an equal distance from the anodes and cathodes or it may be placed closer to one group of electrodes, for example, the anodes than the cathodes. Similarly, the method of supporting or attaching the membranes to support members in the cell is not critical and any suitable means of supporting the membranes may be used.

In a preferred embodiment, one group of electrodes is enclosed in the membrane as described, for example, in U.S. Pat. No. 4,078,987, issued Mar. 14, 1978, to S. J. Specht; U.S. Pat. No. 4,110,191, issued Aug. 29, 1978, to S. J. Specht and John O. Adams; or U.S. Pat. No. 4,115,237, issued Sept. 19, 1978, to K. E. Woodard, Jr. and S. J. Specht. The entire disclosures of U.S. Pat. Nos. 4,078,987; 4,110,191; and 4,115,237 are incorporated by reference herein. In this embodiment, foraminous electrodes are enclosed in an inert, flexible membrane having ion exchange properties and which is impervious to the hydrodynamic flow of the electrolyte and the passage of gas products produced in the cell. Where the enclosed electrodes are anodes, suitably used are cation exchange membranes such as those composed of fluorocarbon polymers having a plurality of pendant sulfonic acid groups or carboxylic acid groups or mixtures of sulfonic acid groups and carboxylic acid groups. The terms sulfonic acid groups and carboxylic acid groups are meant to include salts of sulfonic acid or salts of carboxylic acid which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. du-Pont deNemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic acid compound as described, for example, in U.S. Pat. No. 4,138,373, issued Feb. 6, 1979, to H. Ukihashi et al. A second method of producing the above-described cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable groups which can be converted to carboxyl groups. Carboxylic acid type cation exchange membranes are available commercially from the Asahi Glass Company under the trademark "Flemion".

Cation exchange membranes containing mixtures of sulfonic acid groups and carboxylic acid groups can be produced by chemically substituting a carboxyl group for the sulfonic group in the above-described perfluorosulfonic resin membrane, as described in, for example, U.S. Pat. No. 4,138,373.

Suitable anodes include porous graphite or foraminous metal structures. For example, anodes employed include foraminous metal structures having at least a portion which is coated with an electroconductive, electrocatalytically active material. Suitable metals of which the anodes are composed include a valve metal such as titanium or tantalum or metals such as steel, copper, or aluminum clad with a valve metal. Over at least a part of the surface of the valve metal is a thin coating of an electrocatalytically active material such as a platinum group metal, platinum group metal oxide, an alloy of a platinum group metal, or a mixture thereof. The term "platinum group" as used in this specification means an element of the group consisting of ruthenium, rhodium, palladium, osmium, iridium, and platinum.

Suitable cathodes include foraminous metal structures of metals such as steel, nickel, or copper. The structures are preferably fabricated to facilitate the release of hydrogen gas from the catholyte liquor. The cathode structures employed may have electro-catalytically active coatings similar to those used on the anodes. They may also be coated with metals such as nickel or molybdenum or alloys thereof.

Where electrodes having electrocatalytically active coatings are enclosed by the ion exchange membrane, the electrocatalytically coated portions of the foraminous metal structures are prevented from adhering to the membrane by a spacing means. Direct contact between the membrane and electrocatalytically coated portions results in the loss of current efficiency. When using, for example, anodes having a platinum group coating, direct contact can result in an increased rate in the loss or removal of the platinum group component from the anode surface.

In one embodiment, the spacing means is, for example, a screen or net suitably composed of any non-conducting chemically stable material. Typical examples include glass fiber, asbestos filaments, plastic materials, for example, polyfluoroolefins, polyvinyl chloride, polypropylene and polyvinylidene chloride, as well as materials such as glass fiber coated with a polyfluoroolefin, for example, polytetrafluoroethylene.

To enclose electrodes within the ion exchange membrane, the membrane is obtained in tube or sheet form and sealed, for example, by heat sealing, along the appropriate edges to form a closed casing or "envelope". The anodes and cathodes are preferably of the finger-type which are well known in commercial diaphragm-type electrolytic cells. A preferred type of cell is that in which the finger-like electrodes are attached to vertically positioned electrode plates, as illustrated by U.S. Pat. No. 3,898,149, issued Aug. 5, 1975, to M. S. Kircher and E. N. Macken.

Employing the method of the present invention, the aqueous salt solution to be electrolyzed is fed to the anode compartments of the cell. Simultaneously, a liquid is fed to the cathode compartments. Where, for example, chlorine gas and an aqueous solution of an alkali metal hydroxide are to be produced by the electrolysis of an alkali metal chloride solution, an alkali metal chloride is fed to the anode compartments and a liquid such as water or an alkali metal hydroxide is fed to the cathode compartments. The introduction of these fluids into the cell is carried out so that there is substantially equal pressure on the membrane from each of the electrode compartments. By the phrase substantially equal pressure is meant that the differential pressure between the electrode compartments is equivalent to that of less than about 1 inch, and preferably less than that of 0.5 of an inch of water. Upon contact with the electrolytes, the membrane, if installed in the cell in the "dry" form, is wet by the electrolytes. During this wetting period, the membrane swells and expands. By maintaining substantially equal pressure between the electrode compartments, the expansion of the membrane is allowed to take place free of pressure restraints. This is believed to permit the expansion of the membrane to be transmitted to the perimeter of the membrane and formation of wrinkles in the areas of the membrane which are active during electrolysis is minimized. Where the membrane is installed in the cell in a wetted condition, substantially equal pressure between the electrode compartments is also maintained during the addition of the fluids.

After filling the electrode compartments, the cell is heated, for example, by recirculation of the fluids through heat exchangers. Preferably, the heat is applied at a controlled rate to permit gradual expansion of the membrane. During the heating period, pressure between the anode compartment and the cathode compartment is maintained at the level previously employed.

After the desired cell temperature is reached, pressure is increased in one of the electrode compartments, for example, the anode compartment so that a differential pressure is applied from the anode compartment to the cathode compartment. This differential pressure is equivalent to that in the range of from about 1 to about 4 inches of water and is maintained for a short period, for example, up to about 10 minutes. Pressure in the anode compartment is obtained, for example, by adjusting the fluid levels.

Applying a differential pressure alternately from each of the electrode compartments results in smoothing out wrinkles which may be present on the membrane surface by directing the expansion of the membrane towards its perimeters.

Continuous feeding of the aqueous salt solution to the anode compartment is now begun along with continuous feeding of the electrolyte or water to the cathode compartment. Current is supplied to the anodes to initiate the electrolytic process.

During the cell start-up period, pressure in the anode compartment is periodically increased to provide a differential pressure between the anode compartment and the cathode compartment. This pressure differential is maintained for a brief period when the pressure is reduced and a differential pressure applied from the cathode compartment.

The novel process of the present invention can be used to control dimensional changes at any time that a membrane undergoes expansion or contraction, for example, during cell shutdown periods.

The novel process of the present invention minimizes wrinkling and cracking of the membrane under conditions which cause dimensional changes by preventing excessive mechanical stresses caused by pressure conditions within the cell. Periodic cycling of a differential pressure between the electrode compartments directs the expansion of the membrane towards its perimeters. Leakage through membranes through cracks formed by excessive wrinkling is eliminated.

The following EXAMPLE is presented to more fully illustrate the invention without any intention of being limited thereby.

EXAMPLE

An electrolytic membrane cell for the electrolysis of sodium chloride brines to produce chlorine and sodium hydroxide was equipped with a plurality of titanium mesh anodes having portions covered by a coating having ruthenium dioxide as the electroactive component. A fiber glass open fabric coated with polytetrafluoroethylene and having a thickness of 0.035 of an inch was placed over each mesh anode. The anode mesh and surrounding fabric were enclosed in a perfluorosulfonic acid resin membrane having an equivalent weight of 1200. The membrane was heat sealed to form a casing which was placed over the anode structure and clamped to the anode plate to provide a self-contained compartment. Intermeshed with the anodes were steel screen cathodes which were spaced apart from the membrane about 0.50 of an inch to provide an unobstructed hydrogen release area. Differential pressure monometers using water as the liquid were connected between the anode and cathode compartments. The anode compartments were filled with an alkaline sodium chloride brine containing 24 percent by weight of NaCl. Simultaneously the cathode compartment was filled with an aqueous sodium hydroxide solution containing 28 percent by weight of NaOH. The sodium chloride brine and the sodium hydroxide solution were at ambient temperature. The filling of the electrode compartments was carried out so that the differential pressure between the anode and cathode compartments remained less than 0.5 of an inch of $H_2O$. The cell was heated by recirculating the catholyte through a heat exchanger to raise the temperature to about 55° C. The catholyte level was lowered to provide a differential pressure from the anode compartment to the cathode of one inch of water. The pressure differential was maintained for about 5 minutes after which the catholyte level was increased to provide a differential pressure of 0.25 of an inch of water. Continuous flow of alkaline brine was started to the anode compartments and simultaneously water fed to the cathode compartment at rates which maintained the differential pressure at about 0.25 of an inch of water from the cathode compartment to the anode compartment. Current was fed to the cell to begin the electrolysis process. Acid brine was fed to the anode compartments at a rate which provided a differential pressure of one inch of water from the anode compartment to the cathode compartment. After about 5 minutes, the rate of brine flow was reduced to provide a differential pressure from the cathode compartment to the anode compartment of 2 inches of water. During the first few days of cell operation, the catholyte level was lowered periodically to provide a differential pressure from the anode compartment to the cathode compartment of about 1 inch for a brief period after which the differential pressure was reversed. The cell was operated for one month and then disassembled. Visual examination of the membrane determined that wrinkle formation on the membrane had been reduced by about 50 percent over previous start-up procedures. No cracks or leaks in the membrane were detected.

COMPARATIVE EXAMPLE

The electrolytic cell of the EXAMPLE employing the membrane of the EXAMPLE was started up using the procedure of the EXAMPLE with the following exceptions:

During the initial filling of the anode and cathode compartments with sodium chloride brine and sodium hydroxide, a differential pressure of 5 inches of water from the cathode compartment to the anode compartment was maintained. This differential pressure was maintained at this level throughout the start-up period until current was initially fed to the cells when the differential pressure from the cathode compartment to the anode compartment was raised to about 12 inches of water. Following the operational period, the cell was disassembled and the membrane was inspected. Numerous wrinkles were found on the membrane surface including cracks formed at the intersection of wrinkles.

As shown by the Example, the novel process of the present invention substantially reduces the formation of wrinkles on the membrane surface during the cell starting operation. In addition, compound wrinkles which lead to cracks in the membrane are minimized.

What is claimed is:

1. A process for the start-up of membrane cells for the electrolysis of an aqueous salt solution, said cells having an anode compartment containing a plurality of anodes, a cathode compartment containing a plurality of cathodes, and an ion exchange membrane separating said anode compartment from said cathode compartment, said process which comprises the steps of:

(a) feeding simultaneously said aqueous salt solution to said anode compartment and a liquid to said cathode compartment while maintaining substantially equal pressure on said membrane from each of said compartments, (b) applying pressure to said membrane from said anode compartment, (c) applying pressure to said membrane from said cathode compartment, and (d) cyclically repeating steps b and c during the start-up period.

2. The process of claim 1 in which the pressure on said ion exchange membrane is equalized between steps b and c.

3. The process of claim 1 in which spacing means is employed to space apart said anodes from said membrane.

4. The process of claim 3 in which said anodes are enclosed in said ion exchange membrane.

5. The process of claim 1 or 3 in which said increased pressure in step (b) provides a differential pressure in the range of from about 1 to about 4 inches of water.

6. The process of claim 1 or 3 in which the increased pressure in step (c) provides a differential pressure in the range of from about 1 to about 4 inches of water.

7. The process of claim 5 in which said applied pressure is maintained for a time period of up to about 10 minutes.

8. The process of claim 6 in which said applied pressure is maintained for a time period of up to about 10 minutes.

9. The process of claim 1 in which said pressure in step (a) is less than about 0.5 of an inch of water.

10. The process of claim 2 or 4 in which said ion exchange membrane is a fluorocarbon polymer having pendant cation exchange groups selected from the group consisting of sulfonic acid groups, carboxylic acid groups, and mixtures of sulfonic acid groups and carboxylic acid groups.

11. A process for the control of dimensional changes in an ion exchange membrane in cells for the electrolysis of an aqueous salt solution, said cells having two electrode compartments separated by said ion exchange membrane, said process which comprises the steps of:

(a) maintaining substantially equal pressure on said membrane from each of said electrode compartments, (b) increasing pressure to said membrane from one of said electrode compartments, (c) increasing pressure to said membrane from the other of said electrode compartments, and (d) periodically repeating steps (b) and (c).

* * * * *